US005523024A

United States Patent [19]

Garabedian, Jr. et al.

[11] Patent Number: 5,523,024

[45] **Date of Patent: *Jun. 4, 1996**

[54] REDUCED RESIDUE HARD SURFACE CLEANER

[75] Inventors: Aram Garabedian, Jr., Fremont; Scott C. Mills, Livermore; William P. Sibert, San Ramon; Clement K. Choy, Alamo, all of Calif.

[73] Assignee: The Clorox Company, Oakland, Calif.

[ * ] Notice: The term of this patent shall not extend beyond the expiration date of Pat. No. 5,252,245.

[21] Appl. No.: 518,384

[22] Filed: Aug. 23, 1995

Related U.S. Application Data

[63] Continuation-in-part of Ser. No. 410,470, Mar. 24, 1995, and a continuation-in-part of Ser. No. 134,348, Oct. 8, 1993, Pat. No. 5,437,807, which is a continuation-in-part of Ser. No. 832,275, Feb. 7, 1992, Pat. No. 5,252,245.

[51] Int. Cl.[6] ..... C11D 1/66; C11D 3/26; C11D 3/28; C11D 3/43

[52] U.S. Cl. ..... 252/547; 252/153; 252/173; 252/546; 252/548; 252/DIG. 10; 134/42

[58] Field of Search ..... 252/153, 173, 252/547, 548, 546, DIG. 10; 134/42

[56] References Cited

U.S. PATENT DOCUMENTS

| | | | |
|---|---|---|---|
| H269 | 5/1988 | Malik et al. | 252/542 |
| 3,173,876 | 3/1965 | Zobrinski | 252/137 |
| 3,591,510 | 7/1971 | Zenk | 252/137 |
| 3,615,825 | 10/1971 | Gansser | 134/38 |
| 3,679,608 | 7/1972 | Aubert et al. | 252/526 |
| 3,839,234 | 10/1974 | Roscoe | 252/544 |
| 3,882,038 | 5/1975 | Clayton et al. | 252/164 |
| 3,912,662 | 10/1975 | Martinsson et al. | 252/527 |
| 3,960,782 | 6/1976 | Daley et al. | 252/544 |
| 4,069,066 | 1/1978 | Hindle et al. | 134/6 |
| 4,107,095 | 8/1978 | Klisch et al. | 252/541 |
| 4,115,548 | 9/1978 | Marsh et al. | 424/70 |
| 4,174,304 | 11/1979 | Flanagan | 252/524 |
| 4,203,872 | 5/1980 | Flanagan | 252/542 |
| 4,213,873 | 7/1980 | Church | 252/174.21 |
| 4,264,479 | 4/1981 | Flanagan | 252/542 |
| 4,302,348 | 11/1981 | Requejo | 252/135 |
| 4,315,828 | 2/1982 | Church | 252/153 |
| 4,421,680 | 12/1983 | Shivar | 252/526 |
| 4,486,329 | 12/1984 | Ellis et al. | 252/117 |
| 4,540,505 | 9/1985 | Frazier | 252/106 |
| 4,673,523 | 6/1987 | Smith et al. | 252/91 |
| 4,681,704 | 7/1987 | Bernadino et al. | 252/546 |
| 4,690,779 | 9/1987 | Baker et al. | 252/546 |
| 4,749,509 | 6/1988 | Kacher | 252/139 |
| 4,784,786 | 11/1988 | Smith et al. | 252/91 |
| 4,797,231 | 1/1989 | Schumann et al. | 252/547 |
| 4,863,629 | 9/1989 | Osberghaus et al. | 252/162 |
| 4,904,359 | 2/1990 | Pancheri et al. | 252/548 |
| 4,921,679 | 5/1990 | Mahil et al. | 252/170 |
| 4,948,531 | 8/1990 | Faggini et al. | 252/544 |
| 4,976,885 | 12/1990 | Wisetzki et al. | 252/17.117 |
| 4,992,213 | 2/1991 | Mallett et al. | 252/546 |
| 5,030,374 | 7/1991 | Tranner | 252/90 |
| 5,102,573 | 4/1992 | Han et al. | 252/153 |
| 5,106,525 | 4/1992 | Sullivan | 252/162 |
| 5,108,660 | 1/1993 | Michael | 252/545 |
| 5,126,068 | 6/1992 | Burke | 252/174.21 |
| 5,180,660 | 4/1992 | Michael | 252/545 |
| 5,232,632 | 8/1993 | Woo et al. | 252/546 |
| 5,252,245 | 10/1993 | Garabedian, Jr. et al. | 252/153 |
| 5,290,472 | 3/1994 | Michael | 252/170 |
| 5,294,644 | 3/1994 | Login et al. | 252/357 |
| 5,298,195 | 3/1994 | Brumbaugh | 252/547 |
| 5,336,445 | 8/1994 | Michael et al. | 252/548 |
| 5,342,549 | 8/1994 | Michael | 252/546 |
| 5,362,422 | 11/1994 | Masters | 252/544 |
| 5,437,807 | 8/1995 | Garabedian, Jr. et al. | 252/153 |
| 5,454,984 | 10/1995 | Granbart et al. | 252/547 |
| 5,468,423 | 11/1995 | Garabedian, Jr. et al. | 252/546 |

FOREIGN PATENT DOCUMENTS

| | | | |
|---|---|---|---|
| 714521 | 7/1965 | Canada . | |
| 288856 | 11/1985 | European Pat. Off. . | |
| 344847 | 12/1989 | European Pat. Off. | C11D 3/43 |
| 0393772 | 10/1990 | European Pat. Off. | C11D 1/88 |
| 0428816 | 5/1991 | European Pat. Off. | C11D 3/43 |
| 0442251 | 8/1991 | European Pat. Off. | C11D 3/43 |
| 595383 | 5/1994 | European Pat. Off. | C11D 1/92 |
| 647706 | 10/1994 | European Pat. Off. | C11D 3/43 |
| 62-01797 | 1/1987 | Japan | C11D 7/60 |
| 3-251122 | 3/1993 | Japan | C11D 10/02 |
| 3-213896 | 3/1993 | Japan | C11D 7/50 |
| 1081202 | 1/1993 | U.S.S.R. | C11D 1/66 |
| 2133415 | 7/1984 | United Kingdom . | |
| 2160887 | 1/1986 | United Kingdom | C11D 1/83 |
| 91/11505 | 8/1991 | WIPO | C11D 1/90 |
| 93/04151 | 3/1993 | WIPO | C11D 1/83 |

OTHER PUBLICATIONS

Database Abstract of US 5,053,159 Oct. 1, 1991.
Chem. Abs. 75:65509r (1971).
WIPO/EPO Search Report on PCT/US 93/00599 (equivalent to U.S. Ser. No. 07/832,275. parent hereof).

*Primary Examiner*—Margaret Einsmann
*Assistant Examiner*—Michael P. Tierney
*Attorney, Agent, or Firm*—Joel J. Hayashida; Michael J. Mazza; Harry A. Pacini

[57] ABSTRACT

The invention provides an aqueous, hard surface cleaner with significantly improved residue removal and substantially reduced filming/streaking, said cleaner comprising:

(a) an effective amount of at least one organic solvent with a vapor pressure of at least 0.001 mm Hg at 25° C., and mixtures of such solvents;

(b) an effective amount of at least one semi-polar nonionic surfactant, said surfactant having the structure:

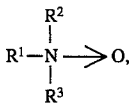

wherein $R^1$ is $C_{5-20}$ alkyl, $R^2$ and $R^3$ are both $C_{1-4}$ alkyl, or $—(CH_2)_p—OH$, although $R^2$ and $R^3$ do not have to be equal, and p is 1–6;

(c) an effective amount of a buffering system which comprises a nitrogenous buffer which will result in a pH of greater than 6.5; and (d) the remainder as substantially all water.

9 Claims, No Drawings

REDUCED RESIDUE HARD SURFACE CLEANER

This is a continuation-in-part of applications Ser. No. 08/134,348, filed Oct. 8, 1993, now U.S. Pat. No. 5,437,807, itself a continuation-in-part of application Ser. No. 07/832,275, filed Feb. 7, 1992, now U.S. Pat. No. 5,252,245; and 08/410,470, filed Mar. 24, 1995.

BACKGROUND OF THE INVENTION

1. Field of the Invention

The invention relates to a non-rinse, isotropic hard surface cleaner especially adapted to be used on glossy or smooth, hard surfaces, such as glass windows and the like, which removes soils deposited thereon, while significantly reducing the amount of residue caused by unremoved soil, cleaner, or a combination thereof.

2. Brief Statement of the Related Art

Cleaning hard, glossy surfaces such as glass windows has proven to be problematic. To remove soils deposited on such surfaces, the typical approach is to use an alkaline ammonium-based aqueous cleaner or other aqueous cleaners containing various mixtures of surfactants and other cleaning additives. Unfortunately, many of the ammonia-based cleaners have fairly poor soil removing ability, while many of the surfactant-based cleaners leave fairly significant amounts of residue on such hard, glossy surfaces. This residue is seen in the phenomena of streaking, in which the soil, cleaner, or both are inconsistently wicked off the surface, and filming, in which a thin layer of the residue actually clings to the surface desired to be cleaned.

Baker et al., U.S. Pat. No. 4,690,779, demonstrated a hard surface cleaner having improved non-streaking/filming properties in which a combination of low molecular weight polymer (e.g., polyethylene glycol) and certain surfactants were combined.

Corn et al., E.P. 0393772 and E.P. 0428816, describe hard surface cleaners containing anionic surfactants with ammonium counterions, and additional adjuncts.

G.B. 2,160,887 describes a cleaning system in which a combination of nonionic and anionic surfactants (including an alkanolamine salt alkyl sulfate) is contended to enhance cleaning efficacy.

WO 91/11505 describes a glass cleaner containing a zwitterionic surfactant, monoethanolamine and/or beta-aminoalkanols as solvents/buffers for assertedly improving cleaning and reducing filming spotting.

Garabedian et al., U.S. Pat. Nos. 5,252,245 and 5,437,807, and their related application, U.S. patent application Ser. No. 08/134,348, filed Oct. 8, 1993, all of common assignment herewith, disclose improved glass and surface cleaners which combine either amphoteric or nonionic surfactants with solvents and effective buffers to provide excellent streaking/filming characteristics on glass and other smooth, glossy surfaces. These disclosures are incorporated herein by reference thereto.

SUMMARY OF THE INVENTION AND OBJECTS

The invention provides an aqueous, hard surface cleaner with significantly improved residue removal and substantially reduced filming/streaking, said cleaner comprising:

(a) an effective amount of at least one organic solvent with a vapor pressure of at least 0.001 mm Hg at 25° C., and mixtures of such solvents;

(b) an effective amount of at least one semi-polar nonionic surfactant, said surfactant having the structure:

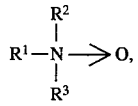

wherein $R^1$ is $C_{5-20}$ alkyl, $R^2$ and $R^3$ are $C_{1-4}$ alkyl, or $—(CH_2)_p—OH$, although $R^2$ and $R^3$ do not have to be equal, and p is 1–6, preferably 2–3;

(c) an effective amount of a buffering system which comprises a nitrogenous buffer which will result in a pH of greater than 6.5; and (d) the remainder as substantially all water.

The invention provides an all-temperature, improved glass and other hard surface cleaner having excellent streaking/filming performance as compared to the prior art. The improvement is especially striking when cleaning glass and other glossy, hard surfaces with the invention.

In another embodiment of the invention, the cleaner further comprises (e) an effective amount of an additional dispersant, namely, an n-alkylpyrrolidone. This particular adjunct has proven to be surprisingly effective at both dispersing highly insoluble organic materials, particularly, fragrance oils, while simultaneously enhancing or maintaining the effective minimization of streaking/filming of the surfaces cleaned with the inventive cleaner. Further, the addition of discrete amounts of certain anionic surfactants, e.g., alkylsulfates, can provide other desirable cleaning attributes. Other dispersants such as nonionic surfactants can also provide desirable functions, such as fragrance dispersion, added cleaning, etc.

The invention further comprises a method of cleaning soils from hard surfaces by applying said inventive cleaner to said soil (such as by, e.g., using a pump or trigger sprayer to conveniently and effectively deliver metered amounts of the cleaner to the soiled surface), and removing both from said surface.

It is therefore an object of this invention to substantially eliminate filming which results from a residue of cleaner, soil, or both remaining on the hard surface intended to be cleaned.

It is another object of this invention to substantially eliminate streaking, which results from inconsistent removal of the cleaner, soil, or both, from the hard surface intended to be cleaned.

It is also an object of this invention to provide a cleaner for glass and other hard, glossy surfaces, which has virtually no filming or streaking.

DETAILED DESCRIPTION OF THE INVENTION

The invention is an improved cleaning, substantially non-streaking/filming hard surface cleaner especially adapted to be used on glossy or smooth, hard surfaces, emblematic of which is glass. The cleaner benefits from the use of a novel surfactant which contributes unexpectedly to the complete removal of soils and the cleaner from the surface being cleaned. The cleaner itself has the following ingredients:

(a) an effective amount of at least one organic solvent with a vapor pressure of at least 0.001 mm Hg at 25° C., and mixtures of such solvents;

(b) an effective amount of at least one semi-polar nonionic surfactant, said surfactant having the structure:

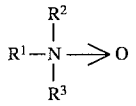

wherein $R^1$ is $C_{5-20}$ alkyl, $R^2$ and $R^3$ are $C_{1-4}$ alkyl, or $—(CH_2)_p—OH$, although $R^2$ and $R^3$ do not have to be equal, and p is 1–6, preferably 2–3;

(c) an effective amount of a buffering system which comprises a nitrogenous buffer which will result in a pH of greater than 6.5; and (d) the remainder as substantially all water.

Additional adjuncts in small amounts such as fragrance, dye and the like can be included to provide desirable attributes of such adjuncts. In a further embodiment of the invention, especially when a fragrance is used, a further adjunct (e) a 1-alkyl-2-pyrrolidone is added in amounts effective to disperse the fragrance and to improve or maintain the reduced streaking/filming performance of the inventive cleaner. In yet another embodiment, an anionic surfactant is present in discrete amounts to provide other desirable cleaning attributes.

In the application, effective amounts are generally those amounts listed as the ranges or levels of ingredients in the descriptions which follow hereto. Unless otherwise stated, amounts listed in percentage ("%'s") are in weight percent of the composition, unless otherwise noted.

1. Solvents

The solvents useful in this invention are organic solvents with a vapor pressure of at least 0.001 mm Hg at 25° C. and soluble to the extent of at least 1 g/100 ml water. The upper limit of vapor pressure appears to be about 100 mm Hg at 25° C. Vapor pressure is a useful measure for determining the applicability of the given solvent, since one would select a solvent which will volatilize sufficiently so as to leave no visible residue. The organic solvent of the invention is preferably selected from $C_{1-6}$ alkanol, $C_{3-24}$ alkylene glycol ether, and mixtures thereof. However, other, less water soluble or dispersible organic solvents may also be utilized. It is preferred that a mixture of the $C_{1-6}$ alkanol and $C_{3-24}$ alkylene glycol ether solvents be used. The alkanol can be selected from methanol, ethanol, n-propanol, isopropanol, butanol, pentanol, hexanol, their various positional isomers, and mixtures of the foregoing. In the invention, it has been found most preferable to use isopropanol, usually in conjunction with a glycol ether. It may also be possible to utilize in addition to, or in place of, said alkanols, the diols such as methylene, ethylene, propylene and butylene glycols, and mixtures thereof. Other solvents, such as amines, ketones, ethers, hydrocarbons and halides may be used. In the case of certain amines, e.g., monoethanolamine, diethanolamine, etc., such solvents are also considered buffers (as described further below in 4). Thus, it is possible that, in certain instances, these amines can be bifunctional herein, although it is cautioned that, strictly from the point of aesthetics, amines have a characteristic odor which some may find not entirely pleasing. Other examples of solvents can be found in *Kirk-Othmer, Encyclopedia of Chemical Technology* 3rd, Vol. 21, pp. 377–401 (1983), incorporated by reference herein.

The alkylene glycol ether solvents can include ethylene glycol monobutyl ether, ethylene glycol monopropyl ether, propylene glycol monopropyl ether, propylene glycol monobutyl ether, and mixtures thereof. One preferred glycol ether is ethylene glycol, monobutyl ether, also known as 2-butoxyethanol, sold as Butyl Cellosolve by Union Carbide. A particularly preferred alkylene glycol ether is propylene glycol, t-butyl ether, which is commercially sold as Arcosolve PTB, by Arco Chemical Co. It has the structure:

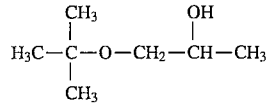

It has been unexpectedly found that the propylene glycol t-butyl ether is especially preferred in the formulations of the invention. Propylene glycol n-butyl ether is also a suitable solvent for use herein. This particular solvent readily improves the non-streaking/non-filming performance. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. However, in some of the compositions of this invention, no solvent may be present. A preferred range is about 1–15%, and if a mixed solvent system of alkanol/glycol ether is used, the ratio of alkanol to alkylene glycol ether should be about 1:20 to 20:1, more preferably about 1:10 to 1:10 and most preferably about 1:5 to 5:1.

As mentioned above, other, less water soluble or dispersible organic solvents may also be utilizable herein, although in a high water formulation, there may be a need for a further dispersant (e.g., hydrotrope or other emulsifier). These less water soluble or dispersible organic solvents include those commonly used as constituents for proprietary fragrance blends, such as terpene derivatives. The terpene derivatives herein include terpene hydrocarbons with a functional group. Effective terpenes with a functional group include, but are not limited to, alcohols, ethers, esters, aldehydes and ketones.

Representative examples for each of the above classes of terpenes with functional groups include but are not limited to the following: Terpene alcohols, including, for example, verbenol, transpinocarveol, cis-2-pinanol, nopol, isoborneol, carbeol, piperitol, thymol, -terpineol, terpinen-4-ol, menthol, 1,8-terpin, dihydro-terpineol, nerol, geraniol, linalool, citronellol, hydroxycitronellol, 3,7-dimethyl octanol, dihydro-myrcenol, -terpineol, tetrahydro-alloocimenol and perillalcohol; Terpene ethers and esters, including, for example, 1,8-cineole, 1,4-cineole, isobornyl methylether, rose pyran, α-terpinyl methyl ether, menthofuran, trans-anethole, methyl chavicol, allocimene diepoxide, limonene mono-epoxide, iso-bornyl acetate, nopyl acetate, α-terpinyl acetate, linalyl acetate, geranyl acetate, citronellyl acetate, dihydro-terpinyl acetate and neryl acetate; Terpene aldehydes and ketones, including, for example, myrtenal, campholenic aldehyde, perillaldehyde, citronellal, citral, hydroxy citronellal, camphor, verbenone, carvenone, dihyro-carvone, carvone, piperitone, menthone, geranyl acetone, pseudo-ionone, α-ionone, β-ionone, iso-pseudo-methyl ionone, normal-pseudo-methyl ionone, iso-methyl ionone and normal-methyl ionone.

Terpene hydrocarbons with functional groups which appear suitable for use in the present invention are discussed in substantially greater detail by Simonsen and Ross, *The Terpenes*, Volumes I–V, Cambridge University Press, 2nd Ed., 1947 (incorporated herein by reference thereto). See also, the commonly assigned U.S. Pat. No. 5,279,758, of Choy, incorporated herein by reference thereto.

2. Surfactants

The surfactant is a semi-polar nonionic surfactant known as an trialkylamine oxide. Its structure is shown below:

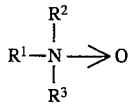

wherein $R^1$ is $C_{5-20}$ alkyl, $R^2$ and $R^3$ are $C_{1-4}$ alkyl, — or —$(CH_2)_p$—OH, although $R^2$ and $R^3$ do not have to be equal or the same substituent, and p is 1–6, preferably 2–3. Additionally, the surfactant could be ethoxylated (1–10 moles of EO/mole) or propoxylated (1–10 moles of PO/mole).

The preferred surfactant is available from various sources, including from Lonza Chemical Company, as a lauryldimethyl amine oxide (sometimes referred to as a cocodimethyl amine oxide), sold under the brand name Barlox 12. These particular surfactants have proven to have surprisingly excellent streaking/filming characteristics when formulated with the solvents and buffers of the invention. It is not understood why this is so, since this particular surfactant has not heretofore been disclosed, taught or suggested for incorporation in a substantially non-streaking/filming hard surface cleaner. It is speculated that this surfactant interacts particularly well with buffers to disperse same, resulting in the unexpectedly desirable performance in streaking/filming tests. Further, when this surfactant is used in the hard surface cleaners of the invention, it has been observed that the cleaner can be sprayed on a glass surface, allowed to dry, and yet still can be easily wiped off.

It has also been observed that these surfactants, when formulated into the inventive hard surface cleaners, will outperform comparative surfactants, such as alkylamidoalkylenedialkylbetaines, e.g., as disclosed in Michael, U.S. Pat. No. 5,342,549. In particular, the trialkylamine oxide surfactants of the invention will outperform comparative surfactants under challenging environmental conditions (high and low temperature), as well as in tests where the cleaner is merely sprayed onto a hard surface and not wiped or wicked off.

It is also desirable to add discrete amounts of additional surfactants for various cleaning purposes. It is of course cautioned that adding additional surfactants, indeed, any other adjunct materials (such as dyes, fragrances, high ionic strength materials, such as chelating agents and builders), must be carefully monitored to avoid the leaving a residue from the added material itself.

For example, one can add a small amount of an anionic surfactant, for both cleaning and desirable foaming characteristics. The anionic surfactant is selected from alkyl sulfates, alkylbenzene sulfonates, alkylsulfonates, iseothionates, alkylethersulfates, α-olefin sulfonates, alkyl taurates, alkyl sarcosinates and the like. Each of these surfactants is generally available as the alkali metal, alkaline earth and ammonium salts thereof. The preferred anionic surfactant is alkyl sulfate, more preferably, $C_{6-16}$ alkyl sulfates. One particularly preferred sulfate is sodium lauryl ($C_{12}$) sulfate, available from Stepan Chemical Co., under the brand name Stepanol WAC. Because it appears desirable to limit the total amount of sodium ion present in the invention, it may also be preferred to use the alkaline earth salts of alkyl sulfates, particularly magnesium, and, less preferably, calcium, to bolster non-streaking/non-filming performance. Magnesium salts of the anionic surfactants are commercially available, however, a viable alternative is to form the magnesium salts in situ by the addition of soluble $Mg^{++}$ salts, such as $MgCl_2$, and the like. Calcium salts suitable for use would be $CaCl_2$, and the like. The level of these salts may be as high as 200 ppm, although less than 100 ppm is preferred, especially less than 50 ppm.

Further nonionic surfactants may be desirable for inclusion and are selected from alkoxylated alcohols, alkoxylated ether phenols, and other semi-polar nonionics, such as the non-derivatized straight chain trialkyl amine oxides. The alkoxylated alcohols include ethoxylated, and ethoxylated and propoxylated $C_{6-16}$ alcohols, with about 2–10 moles of ethylene oxide, or 1–10 and 1–10 moles of ethylene and propylene oxide per mole of alcohol, respectively. The preferred ethoxylated alcohols include those available from Union Carbide under the trademark "Triton" and from Shell Chemical Company under the trademark "Neodol." The semi-polar alkylamidoalkylene dialkyl amine oxides could be added, although, again, it is noted that these surfactants have themselves been used as the primary surfactant in comparative hard surface cleaners (e.g., Garabedian et al., U.S. patent application Ser. No. 08/410,470, filed Mar. 24, 1995). These have the general configuration:

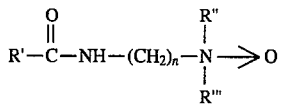

wherein R' is $C_{6-24}$ alkyl, and R" and R'" are $C_{1-4}$ alkyl,

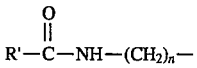

or —$(CH_2)_p$—CH, although R" and R'" do not have to be equal, and n is 1–5, preferably 3, p is 1–6, preferably 2–3. These amine oxides can also be ethoxylated or propoxylated. The preferred amine oxide is lauryl amine oxide, such as Barlox C, from Lonza Chemical Company.

An amphoteric surfactant may also be desirable for addition in discrete amounts, although it is also observed that it has been used in comparative formulations against which the invention has been compared and in which the invention was found generally to have superior performance. The amphoteric surfactant is typically an alkylbetaine or a sulfobetaine. Especially preferred are alkylamidoalkyldialkylbetaines. These have the structure:

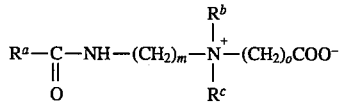

wherein $R^a$ is $C_{6-20}$ alkyl, $R^b$ and $R^c$ are both $C_{1-4}$ alkyl, although $R^b$ and $R^c$ do not have to be equal, and m can be 1–5, preferably 3, and o can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

The amounts of surfactants present are to be somewhat minimized, for purposes of cost-savings and to generally restrict the dissolved actives which could contribute to leaving behind residues when the cleaner is applied to a surface. In a preferred composition, the at least one semi-polar nonionic surfactant, trialkylamine oxide, is present, in an amount of about 0.001–10%, more preferably about 0.001–7.5%, and most preferably about 0.001–2%, total surfactant. (When the higher end—towards 10% —of the broadest range of surfactant in this preferred embodiment is used, the resulting composition is often referred to, commercially as a "concentrate." The concentrate can be diluted by a factor of 1:1 to 1:500 concentrate: water, in order to obtain various concentrations for specific cleaning purposes.) In addition, for a glass cleaner, and where a mixture of semi-polar nonionic/anionic/alkylpyrrolidone is used, the amounts added are generally about 0.001–2%, more preferably 0.002–0.75% semi-polar nonionic surfactant, generally about 0–1%, more preferably 0–0.75% anionic surfactant and generally 0.005-2%, more preferably 0.01–1% alkylpyrrolidone surfactant, in the cleaner. The ratios of surfactants are generally about 1:1:10 to 1,000:1:1 semi-polar nonionic/anionic/alkylpyrrolidone, when all three are present. If just two surfactants are used, the ratios will be about 1:1,000 to 1,000:1.

3. Alkylpyrrolidones

The 1-alkyl-2-pyrrolidones can provide a dual function in this invention. First, one of the desirable adjuncts which are added to this system are fragrances, which are typically water-immiscible to slightly water-soluble oils. In order to keep this fairly immiscible component in solution, a co-solvent or other dispersing means was necessary. It was determined that 1-alkyl-2-pyrrolidones were particularly effective at so solubilizing the fragrance oils. However, it was further found that the 1-alkyl-2-pyrrolidones also improve the cleaning performance of the cleaner, especially in streaking/filming. Thus, the compound could also function in place of, or in addition to, the surfactants present in the composition. The compound has the general structure:

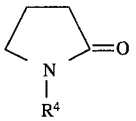

wherein $R^4$ is a $C_{6-20}$ alkyl, or $R^5NHCOR^6$, and $R^5$ is $C_{1-6}$ alkyl and $R^6$ is $C_{6-20}$ alkyl. A particularly preferred alkyl pyrrolidone is lauryl pyrrolidone, sold by ISF Chemicals under the brand name Surfadone. Relatively low amounts of the alkyl pyrrolidone are used, preferably, about 0.001–2%, when the level of fragrance is from about 0.01–5%.

4. Buffer System

The buffer system comprises a nitrogenous buffer which is added to the aqueous hard surface cleaners of the invention so as to result in a pH of greater than 6.5, more preferably, between 7 and 14, most preferably between 7 and 13. The buffer can be selected from the group consisting of: ammonium or alkaline earth carbamates, guanidine derivatives, ammonium carbonate, ammonium bicarbonate, diammonium carbonate, alkanolamines, ammonium hydroxide, ammonia (which forms ammonium hydroxide in situ when added to water) alkoxylalkylamines and alkyleneamines and mixtures thereof. Optionally and preferably, the co-buffer is selected from ammonium and alkaline earth metal hydroxides.

The nitrogenous buffer is a significant aspect of the invention. Because of its presence, greatly enhanced reduction in streaking and filming of hard surfaces is achieved after the inventive cleaner is used to clean the same. The preferred nitrogenous buffers are ammonium carbamate, monoethanolamine, ammonium bicarbonate, ammonium carbonate and ammonium hydroxide. Ammonium carbamate has the structure $NH_2COO^-NH^+_4$. Use of this particularly preferred buffer obtains outstanding reduction in filming/streaking. It is available from BASF Corp. Monoethanolamine is an alkanolamine. Other examples of this type of buffer are diethanolamine, triethanolamine and isopropanolamine. As mentioned in a preceding discussion, the alkanolamines can also function as solvents, although it is intended that the alkanolamines herein be used primarily in their role as buffer. Monoethanolamine has proven to have particularly effective performance in the inventive cleaners. Ammonium carbonate and bicarbonate are other, further desirable buffers. Other, potentially suitable buffers are guanidine derivatives, such as diaminoguanidine and guanidine carbonate; alkoxyalkylamines, such as isopropoxypropylamine, butoxypropylamine, ethoxypropylamine and methoxypropylamine; and alkylamines, such as ethyleneamine, ethylenediamine, ethylenetriamine, ethylenetetramine, diethylenetetramine, triethylenetetramine, tetraethylenepentamine, N,N-dimethylethylenediamine, N-methylenediamine, and other variations of the alkyl and amine substituents. Mixtures of any of the foregoing can be used as the buffer in the buffering system. Most of these materials can be obtained from general chemical supply houses, e.g., Aldrich Chemicals.

Additionally, it is especially preferred to add, as a co-buffer, an ammonium or alkaline earth hydroxide. Most preferred is ammonium hydroxide, which volatilizes relatively easily after being applied, resulting in minimal residue. Ammonium hydroxide also emulsifies fatty soils to a certain extent.

The amount of nitrogenous buffer added should be in the range of 0.01–10%, more preferably 0.01–1%, by weight of the cleaner, while hydroxide, if present, should be added in the range of 0.001–1% by weight of the cleaner.

5. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is most preferred.

Small amounts of adjuncts can be added for improving cleaning performance or aesthetic qualities of the cleaner. Adjuncts for cleaning include additional surfactants, such as those described in *Kirk-Othmer, Encyclopedia of Chemical Technology,* 3rd Ed., Volume 22, pp. 332–432 (Marcel-Dekker, 1983), which are incorporated herein by reference. Inorganic builders, such as silicates and phosphates, are generally avoided in this cleaner, especially those which will contribute a large amount of solids in the formulation which may leave a residue. Aesthetic adjuncts include fragrances, such as those available from Givaudan-Route, Belmay, Henkel KGaA, Firmenich, Dragoco, IFF, Quest and others, and dyes and pigments which can be solubilized or suspended in the formulation, such as diaminoanthraquinones. As mentioned above, the fragrance oils typically require a dispersant, which role is fulfilled by the alkylpyrrolidone. As previously noted, a fragrance is well dispersed by the alkylpyrrolidone while at least maintaining, if not improving, the non-streaking/non-filming performance of the inventive cleaner. The amounts of these cleaning and aesthetic adjuncts should be in the range of 0–2%, more preferably 0–1%.

An additional adjunct of interest herein is hydrotropes, specifically, short chain alkylaryl sulfonates, more specifically, $C_{1-4}$ alkylaryl sulfonates, such as, without limitation, benzene, naphthalene, xylene, cumene and toluene sulfonates. These are typically alkali metal salts and, although it has been cautioned herein that the total level of alkali metal salts is to be limited, in fact, for certain purposes, such as hard surface cleaning (e.g., tile, composite materials such as Formica® and Corian® countertops, and the like), incorporation of hydrotropes in a discrete level may be quite acceptable. The preferred hydrotrope herein is alkali metal xylene sulfonate, wherein the alkali metal is potassium, sodium or lithium. An ammonium salt may also be acceptable. When sodium xylene sulfonate is used in a preferred composition containing amine oxides, it has been surprisingly found that yellowing of certain types of uncolored or white plastic surfaces (especially polyvinyl chloride) is essentially avoided or mitigated. It is not understood why this is so, but by way of theory, which applicants offer only as an explanation but do not intend to be thereby bound, it is believed that amine oxide may partition to such plastic surfaces and the short chain alkylaryl sulfonate interferes with such binding. The amount of short chain alkylaryl sulfonate may be kept economically low, i.e., preferably about 0.01–2%, more preferably 0.02–1% and most preferably, about 0.05–1%. Preferred hydrotropes, among others, include sodium xylene sulfonate, sold in various active levels by Stepan Chemical Company under the brand name Stepanate SXS. Other preferred hydrotropes may be found from Colborn et al., U.S. Pat. No. 4,863,633, column 8, line 20 to column 10, line 22, which are incorporated by reference thereto.

In the following Experimental section, the surprising performance benefits of the various aspects of the inventive cleaner are demonstrated.

EXPERIMENTAL

The following experiments demonstrate the unique cleaning performance of the inventive cleaner.

Example 1

In Table I below, a base formulation "A" is set forth. Generally, the below examples of the compositions of this invention, as well as most of the comparative examples, will be based on the base formulation "A." In some of the examples (2–9), the sodium lauryl sulfate and dodecyl pyrrolidone will be eliminated, so that the effect of the surfactant alone can be determined.

TABLE I

| Ingredient | Formulation A |
|---|---|
| iso-Propyl Alcohol | 5.90% |
| Propyleneglycol t-Butyl Ether | 3.20% |
| Sodium Lauryl Sulfate | 0.005% |
| Dodecyl Pyrrolidone | 0.012% |
| Lauryldimethylamine Oxide | 0.20% |
| Nitrogenous Buffer | 0.25% |
| Fragrance | 0.125% |
| Ammonia | 0.05% |
| Deionized Water | remainder to 100% |

In general, to test the streaking/filming performance of the formulations, a small sample thereof was sprayed on glass mirror tiles and then wiped off. The results were graded by a panel of expert graders, on a scale of 0 to 10, with 0 being the worst and 10, the best.

In Examples 2–9 below, to further demonstrate the uniqueness and unusual behavior of the cocoamidopropylamine oxide surfactant and selected buffers, experiments were conducted in which the invention (Examples 6–9, each example containing a different nitrogenous buffer) was compared against comparative formulations containing different surfactants. In this experiment, the formulations were simply sprayed via a trigger sprayer (consistently, two short bursts) onto glass mirror tiles, and not wiped or wicked off. Then, as discussed above, graded by an expert panel of graders on a 0 to 10 scale (the samples were randomized and the panelists were not informed of the identity of the samples). Examples 2–5 contained cocoamidopropyldimethylbetaine. Examples 2–9, however, did not contain any sodium lauryl sulfate or alkylpyrrolidone. Thus, the streaking/filming performance attributable primarily to the surfactant was tested here.

The results are demonstrated in TABLE II.

TABLE II

Evaluation of Non-wiped glass tiles

| Example | Surfactant | Buffer | Avg'd Grade | Std. Dev. |
|---|---|---|---|---|
| 2 | Cocoamidopropyldimethylbetaine | Carbamate | 6.25 | 0.5 |
| 3 | Cocoamidopropyldimethylbetaine | $NH_4OH$ | 5.75 | 0.96 |
| 4 | Cocoamidopropyldimethylbetaine | Monoethanolamine | 5 | 0.82 |
| 5 | Cocoamidopropyldimethylbetaine | $NH_4HCO_3$ | 6 | 0.82 |
| Average Score | | | 5.75 | |
| 6 | Cocodimethylamine oxide | Carbamate | 6.75 | 1.25 |
| 7 | Cocodimethylamine oxide | $NH_4OH$ | 6.25 | 0.95 |
| 8 | Cocodimethylamine oxide | Monoethanolamine | 7.5 | 0.57 |
| 9 | Cocodimethylamine oxide | $NH_4HCO_3$ | 6.5 | 0.57 |
| Average Score | | | 6.75 | |

From the foregoing table, it can be seen that the invention, as demonstrated by Examples 6–9 clearly outperformed the comparative examples. This was very unexpected.

In the next set of experiments, Examples 10–20, the invention (14–17), comparative formulations (10–13), and three commercial glass and surface cleaners (20–22), were tested on heated (38.8° C.) glass tiles. The purpose of this test was to determine whether the hard surface cleaner of the invention would perform well in a challenging environment, such as in a very hot, dry climate (e.g., the Southwestern United States). In these examples, the products were sprayed onto the heated glass tiles and wiped off, then graded on a 0 to 10 scale. These visual grades are not replicates. Examples 10–17 followed the base formulation A, above, except as noted in the Table and except for the lack of sodium lauryl sulfate and dodecylpyrrolidone.

TABLE III 38.8° C. Filming/Streaking

| Example | Surfactant | Buffer(s) | Grade |
|---|---|---|---|
| 10 | Cocoamidopropyldimethyl betaine | 0.05% $NH_4OH$; 0.25% carbamate | 4.7 |
| 11 | Cocoamidopropyldimethyl betaine | 0.05% $NH_4OH$ | 4 |
| 12 | Cocoamidopropyl- | 0.25% MEA | 4 |

TABLE III-continued

| 38.8° C. Filming/Streaking | | | |
|---|---|---|---|
| Example | Surfactant | Buffer(s) | Grade |
| | dimethyl betaine | | |
| 13 | Cocoamidopropyl-dimethyl betaine | 0.25% $NH_4HCO_3$ | 5 |
| 14 | Cocodimethylamine oxide | 0.05% $NH_4OH$; 0.25% carbamate | 5 |
| 15 | Cocodimethylamine oxide | 0.05% $NH_4OH$ (29% active) | 5.7 |
| 16 | Cocodimethylamine oxide | 0.25% MEA | 6 |
| 17 | Cocodimethylamine oxide | 0.25% $NH_4HCO_3$ | 6.7 |
| 18 | Commercial Product A (amidobetaine) | | 2.3 |
| 19 | Commercial Product B | | 1.7 |

TABLE III-continued

| 38.8° C. Filming/Streaking | | | |
|---|---|---|---|
| Example | Surfactant | Buffer(s) | Grade |
| | (suspected sulfobetaine) | | |
| 20 | Commercial Product C (suspected sulfobetaine) | | 4.3 |

In the next series of experiments, the invention is compared against a prior art cleaner. Church, U.S. Pat. No. 4,213,873, appears to disclose the use of ammonium carbamate as a "grease cutter" in a hard surface cleaning composition. Church, however, requires the presence of a methoxypolyethylene glycol or polyethylene glycol "lubricity agent." Further, it must be noted that Church's own conclusions on the Windex examples—in which no polymer was apparently used—were that very poor cleaning resulted, with his own conclusion: "A great many oil streaks all over the surface." (See Church, U.S. Pat. No. 4,213,873, column 30, TABLE XVI). Thus, Church requires the presence of the lubricity agents to test formulations which, as in Church, must contain methoxypolyethylene glycol or polyethylene, glycol, the invention (Example 22) was fairly tested against two methoxypolyethylene glycol Example (23–24) and three polyethylene glycol Examples (25–27). The formulations are depicted in TABLE IV below, and the streaking/filming performance are in TABLE V below:

TABLE IV

| Comparison between the Invention and cleaners with added polymers | | | | | | |
|---|---|---|---|---|---|---|
| Material | 22 wt % | 23 wt % | 24 wt % | 25 wt % | 26 wt % | 27 wt % |
| Deionized Water | Balance | Balance | Balance | Balance | Balance | Balance |
| Solvent[1] | 3.2 | 3.2 | 3.2 | 3.2 | 3.2 | 3.2 |
| Solvent[2] | 5.9 | 5.9 | 5.9 | 5.9 | 5.9 | 5.9 |
| Surfactant[3] | 0.005 | 0.005 | 0.005 | 0.005 | 0.005 | 0.005 |
| Surfactant[4] | 0.2 | 0.2 | 0.2 | 0.2 | 0.2 | 0.2 |
| Polymer[5] | | 0.03 | | | | |
| Polymer[6] | | | 0.08 | | | |
| Polymer[7] | | | | 0.07 | | |
| Polymer[8] | | | | | 0.10 | |
| Polymer[9] | | | | | | 0.05 |
| Alkylpyrrolidone[10] | 0.012 | 0.012 | 0.012 | 0.012 | 0.012 | 0.012 |
| Fragrance[11] | 0.14 | 0.14 | 0.14 | 0.14 | 0.14 | 0.14 |
| Dyes[12] | 0.00088 | 0.00088 | 0.00088 | 0.00088 | 0.00088 | 0.00088 |
| $NH_4OH$[13] | 0.05 | 0.05 | 0.05 | 0.05 | 0.05 | 0.05 |
| $NH_4$ carbamate[13] | 0.25 | 0.25 | 0.25 | 0.25 | 0.25 | 0.25 |
| Totals | 100 | 100 | 100 | 100 | 100 | 100 |

[1]Propylene glycol, t-butyl ether, from Arco Chemical Co.
[2]Isopropanol
[3]Sodium lauryl sulfate surfactant, from Stepan Chemical Co.
[4]Coco dimethyl amine oxide, from Lonza Chemical Co.
[5]MPEG 550, methoxypolyethylene glycol, mol wt. range 525–575, avg. 550, from Union Carbide.
[6]MPEG 2000, methoxypolyethylene glycol, mol. wt. range 1,900–2,100, avg. 2,000, from Union Carbide.
[7]PEG 400, polyethylene glycol, mol. wt. range 380–420, avg. 400, from Union Carbide.
[8]PEG 3350, polyethyleneglycol, mol. wt. range 3,000–3,700, avg. 3,350, from Union Carbide.
[9]PEG 20,000, polyethyleneglycol, mol. wt. range 15,000–25,000, avg. 20,000 from UNion Carbide.
[10]Lauryl pyrrolidone, from ISP.
[11]From Givaudan.
[12]Red and Blue Dyes.
[13]Buffers.

TABLE V

| Visual Grading of Formulations | | | |
|---|---|---|---|
| Formulation | Polymer, Mol. Wt. | Streaking/ Filming Grade | Standard Dev. |
| 22 | None (Invention) | 8.8 | 0.8 |
| 23 | MPEG 550 | 0.7 | 0.5 |
| 24 | MPEG 2000 | 2.5 | 0.5 |
| 25 | PEG 400 | 0.2 | 0.4 |
| 26 | PEG 3350 | 0 | 0 |
| 27 | PEG 20,000 | 1.3 | 0.5 |

It is thus clearly demonstrated that the inventive formulation, which contained no polymer, significantly outperformed by a wide margin any of the formulations 23–27, which contained varying levels (from 0.03 to 0.10%), molecular weights (from 400 to 20,000) and types (methoxypolyethylene glycol and polyethylene glycol) polymers, again, as prescribed by Church. The numbers and types of formulations set forth are fair and representative examples of Church's teachings.

The invention is further defined without limitation of scope or of equivalents by the claims which follow.

We claim:

1. An aqueous, hard surface cleaner with significantly improved residue removal and substantially reduced filming/streaking, said cleaner consisting essentially of:

(a) about 1–50% of a solvent selected from $C_{1-6}$ alkanol, $C_{3-24}$ alkylene glycol ether, and mixtures thereof;

(b) an amount effective to substantially reduce streaking/filming of hard surfaces cleaned with said cleaner of at least one semi-polar nonionic surfactant, said surfactant having the structure:

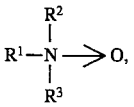

wherein $R^1$ is $C_{6-24}$ alkyl, $R^2$ and $R^3$ are both $C_{1-4}$ alkyl, although $R^2$ and $R^3$ do not have to be equal;

(c) an amount effective to substantially reduce streaking/filming of hard surfaces cleaned with said cleaner of a buffering system which comprises ammonium or alkaline earth carbamates; and (d) the remainder as substantially all water.

2. The hard surface cleaner of claim 1 wherein said solvent is an alkanol which is selected from the group consisting of methanol, ethanol, n-propanol, isopropanol, butanol, pentanol, hexanol, their various positional isomers, and mixtures of the foregoing.

3. The hard surface cleaner of claim 1 wherein said solvent is an alkylene glycol ether which is selected from the group consisting of ethylene glycol monobutyl ether, ethylene glycol monopropyl ether, propylene glycol monopropyl ether, propylene glycol monobutyl ether, and mixtures thereof.

4. The hard surface cleaner of claim 3 wherein said solvent is ethylene glycol monobutyl ether.

5. The hard surface cleaner of claim 3 wherein said solvent is propylene glycol n-butyl ether.

6. The hard surface cleaner of claim 3 wherein said solvent is propylene glycol t-butyl ether.

7. The hard surface cleaner of claim 1 wherein said surfactant further comprises a mixture of the semi-polar nonionic surfactant and an anionic cosurfactant.

8. The hard surface cleaner of claim 1 wherein said buffer further includes an ammonium hydroxide.

9. A method of cleaning soil, without substantial residue remaining, from a hard surface comprising applying the cleaner of claim 1 to said soil and removing said soil and said cleaner.

* * * * *